US010975782B2

(12) United States Patent
Dudar et al.

(10) Patent No.: US 10,975,782 B2
(45) Date of Patent: Apr. 13, 2021

(54) SYSTEMS AND METHODS FOR A VEHICLE COLD-START EVAPORATIVE EMISSIONS TEST DIAGNOSTIC

(71) Applicant: Ford Global Technologies, LLC, Dearborn, MI (US)

(72) Inventors: Aed M. Dudar, Canton, MI (US); Mark W. Peters, Wolverine Lake, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 26 days.

(21) Appl. No.: 16/507,783

(22) Filed: Jul. 10, 2019

(65) Prior Publication Data

US 2019/0331062 A1 Oct. 31, 2019

Related U.S. Application Data

(62) Division of application No. 15/187,431, filed on Jun. 20, 2016, now Pat. No. 10,393,071.

(51) Int. Cl.

| | |
|---|---|
| ***F01N 3/10*** | (2006.01) |
| ***F02D 41/00*** | (2006.01) |
| ***F02M 25/08*** | (2006.01) |
| ***F02D 41/06*** | (2006.01) |
| ***F02D 41/02*** | (2006.01) |

(52) U.S. Cl.

CPC ..... *F02D 41/0035* (2013.01); *F01N 3/103* (2013.01); *F02D 41/004* (2013.01); *F02D 41/0235* (2013.01); *F02D 41/064* (2013.01); *F02M 25/0836* (2013.01); *F02M 25/0854* (2013.01)

(58) Field of Classification Search

CPC ..... F02M 25/0827; F02M 25/0836; F02M 25/0854; F02M 35/10222; F02D 41/004; F02D 41/064; F02D 41/0235; F02D 41/0035; F02D 41/042; F02D 2200/021; F01N 3/103

See application file for complete search history.

(56) References Cited

U.S. PATENT DOCUMENTS

| | | | |
|---|---|---|---|
| 5,056,494 | A | 10/1991 | Kayanuma |
| 5,564,398 | A | 10/1996 | Maeda et al. |
| 5,632,252 | A | 5/1997 | Hyodo et al. |
| 6,530,265 | B2 | 3/2003 | Dawson et al. |

(Continued)

*Primary Examiner* — Matthew T Largi

(74) *Attorney, Agent, or Firm* — Geoffrey Brumbaugh McCoy Russell LLP

(57) ABSTRACT

Methods and systems are provided for conducting an evaporative emissions test diagnostic on a vehicle fuel system and evaporative emissions control system during engine-on conditions. In one example, a first fuel vapor storage device is separated from a second fuel vapor storage device by a one-way check valve, thus preventing loading of the first fuel vapor storage device during conditions such as refueling operations, diurnal temperature fluctuations, or from running-loss vapors from a vehicle fuel tank. In this way, the evaporative emissions test diagnostic may be conducted during a cold-start event where an exhaust catalyst is below a predetermined threshold temperature required for catalytic oxidation of hydrocarbons in the engine exhaust, without increasing undesired exhaust emissions.

6 Claims, 5 Drawing Sheets

(56) References Cited

U.S. PATENT DOCUMENTS

| | | | | |
|---|---|---|---|---|
| 6,604,407 | B2 | 8/2003 | Kano et al. | |
| 7,159,568 | B1 | 1/2007 | Lewis et al. | |
| 7,762,241 | B2 | 7/2010 | Childress et al. | |
| 8,739,766 | B2 | 6/2014 | Jentz et al. | |
| 10,612,479 | B1 * | 4/2020 | Dudar | F02M 25/089 |
| 2002/0174857 | A1 | 11/2002 | Reddy et al. | |
| 2004/0173195 | A1 * | 9/2004 | Ament | F02D 41/1458 123/686 |
| 2009/0007890 | A1 | 1/2009 | Devries et al. | |
| 2009/0288645 | A1 * | 11/2009 | Childress | F02M 25/089 123/520 |
| 2010/0252006 | A1 | 10/2010 | Reddy | |
| 2014/0026866 | A1 * | 1/2014 | Pifher | B60K 15/01 123/520 |
| 2018/0291843 | A1 * | 10/2018 | McQuillen | F02D 41/0255 |
| 2019/0293031 | A1 * | 9/2019 | Dudar | F01N 3/10 |

* cited by examiner

SYSTEMS AND METHODS FOR A VEHICLE COLD-START EVAPORATIVE EMISSIONS TEST DIAGNOSTIC

CROSS REFERENCE TO RELATED APPLICATION

The present application is a divisional of U.S. Non-Provisional patent application Ser. No. 15/187,431, entitled "SYSTEMS AND METHODS FOR A VEHICLE COLD-START EVAPORATIVE EMISSIONS TEST DIAGNOSTIC," and filed on Jun. 20, 2016. The entire contents of the above-referenced application are hereby incorporated by reference for all purposes.

FIELD

The present description relates generally to methods and systems for controlling a vehicle engine to conduct an evaporative emissions test diagnostic procedure during a cold-start event where an exhaust catalyst is below a temperature required for oxidation of exhaust hydrocarbons.

BACKGROUND/SUMMARY

Vehicle evaporative emission control systems may be configured to store fuel vapors from fuel tank refueling and diurnal engine operations, and then purge the stored vapors during a subsequent engine operation. In an effort to meet stringent federal emissions regulations, emission control systems may need to be intermittently diagnosed for the presence of undesired evaporative emissions that could release fuel vapors to the atmosphere.

In one example, an evaporative emissions test diagnostic procedure utilizes engine vacuum to evacuate the evaporative emissions control system and a vehicle fuel system to a target vacuum (e.g., −8 $InH_2O$) during vehicle cruising conditions, where vehicle cruising conditions may comprise a steady state vehicle speed greater than forty miles-per-hour, for example. Responsive to the target vacuum being reached, the evaporative emissions control system and fuel system may be sealed from atmosphere, and a pressure bleed-up may be monitored. A pressure bleed-up rate greater than a predetermined pressure bleed-up rate, or if pressure in the fuel system and evaporative emissions control system reaches a level greater than a predetermined pressure threshold, undesired evaporative emissions may be indicated. However, in some examples it may be difficult to distinguish between undesired evaporative emissions or whether the observed pressure bleed-up is a result of fuel vaporizing due to hot engine exhaust. As such, undesired evaporative emissions may be wrongly indicated under circumstances where large pressure bleed-up occurs due to fuel vaporization effects.

Other attempts to address the difficulties in interpreting whether pressure bleed-up is due to fuel vaporization effects or due to actual undesired evaporative emissions include running the evaporative emissions test diagnostic during cold start conditions. One example approach is shown by Dawson et al. in U.S. Pat. No. 6,530,265. Therein, a method is taught whereby it is first determined whether cold start conditions are met prior to initiating an evaporative emissions test diagnostic utilizing engine vacuum to evacuate the evaporative emissions control system and fuel system. By initiating the test diagnostic under cold start conditions, it is taught that the fuel system may be stable for testing. However, the inventors herein have recognized potential issues with such methods. As one example, such a method may result in undesired emissions due to an exhaust catalyst being below a threshold temperature (e.g., light-off temperature) for oxidation of unburnt hydrocarbons. Specifically, evaporative emissions control systems typically include a fuel vapor canister with a buffer region between a load port of the canister, and the purge port of the canister. The buffer functions to prevent fuel tank vapors from entering the engine directly, and as such, the buffer acts as a vapor filter. At a key-off event, the buffer is typically clean from vapors due to purging events during a previous drive cycle. However, during a soak condition, the buffer may again be loaded from diurnal fuel tank vapors in addition to vapor migration within the canister itself. As such, if a cold-start evaporative emissions test diagnostic is initiated when the buffer is full, undesired emissions may result due to the catalyst being below the threshold temperature.

Thus, the inventors herein have developed systems and methods to at least partially address the above issues. In one example, a method is provided, comprising during a first operating mode, routing fuel vapors from a fuel tank through a first vapor storage device into an intake manifold of an internal combustion engine; and during a second operating mode, routing fuel vapors from the fuel tank through a second vapor storage device but not through the first vapor storage device. Such modes may be accomplished via a first vapor storage device being separated from a second vapor storage device by a one way vacuum-actuated check valve.

As one example, during the first operating mode, fuel vapors from the fuel tank and not from the second fuel vapor storage device are routed through the first vapor storage device. As such, during an engine cold start event where an exhaust catalyst is below a temperature required for catalytic activity, an evaporative emissions test diagnostic may be conducted using engine intake manifold vacuum to evacuate a fuel system and evaporative emissions control system, wherein fuel vapors from the fuel tank are adsorbed by the first fuel vapor storage device. In this way, the evaporative emissions test may be conducted under cold start conditions, without an increase in undesired exhaust emissions during the cold start event, and wherein the results of the evaporative emissions test are not complicated by the effects of fuel vaporization on pressure in the fuel system and evaporative emissions control system.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to systems and methods for conducting an engine-on evaporative emissions test diagnostic procedure. Specifically, responsive to an indication of a cold-start event, where one or more of an engine coolant temperature is below a predetermined temperature, an ambient temperature is below a preset temperature for a predetermined time, and/or wherein a catalyst coupled to an exhaust of a vehicle engine is below a temperature sufficient for catalytic oxidation of hydrocarbons in the exhaust, and engine-on evaporative emissions test may be conducted without undesired exhaust emissions. Furthermore, by conducting the evaporative emissions test diagnostic during cold-start conditions, complications in interpreting the results of the evaporative emissions test diagnostic due to fuel vaporization effects, may be reduced. The systems and methods may be applied to a vehicle wherein power for propelling the vehicle is provided, at least in part, by an internal combustion engine, such as the hybrid vehicle system depicted in FIG. 1. Such a vehicle system may include a fuel system and an evaporative emissions control system coupled to the engine, wherein a first fuel vapor storage device (e.g., buffer) in the evaporative emissions control system is separated from a second fuel vapor storage device by a vacuum-actuated one-way check valve, as depicted in FIG. 2. As such, during vapor purging conditions, vapors may be purged from the fuel tank through the first fuel vapor storage device, and vapors may be purged from the second fuel vapor storage device through the first fuel vapor storage device into an intake manifold of the engine. Responsive to turning off the engine, or during vehicle-off conditions, fuel vapors from the fuel tank may be routed through the second fuel vapor storage device but not through the first fuel vapor storage device. Furthermore, during a cold-start of the engine, fuel vapors may be routed from the first fuel vapor storage device to the intake manifold, but not through the second fuel vapor storage device. Accordingly, an example method for conducting a purging operation of the first fuel vapor storage device and the second fuel vapor storage device is illustrated in the example method depicted in FIG. 3. An example method for conducting an evaporative emissions test diagnostic during a cold-start event is illustrated in the example method depicted in FIG. 4. An example timeline illustrating a purging event, and an evaporative emissions test diagnostic conducted during a cold-start event, is illustrated in FIG. 5.

Figure 1:
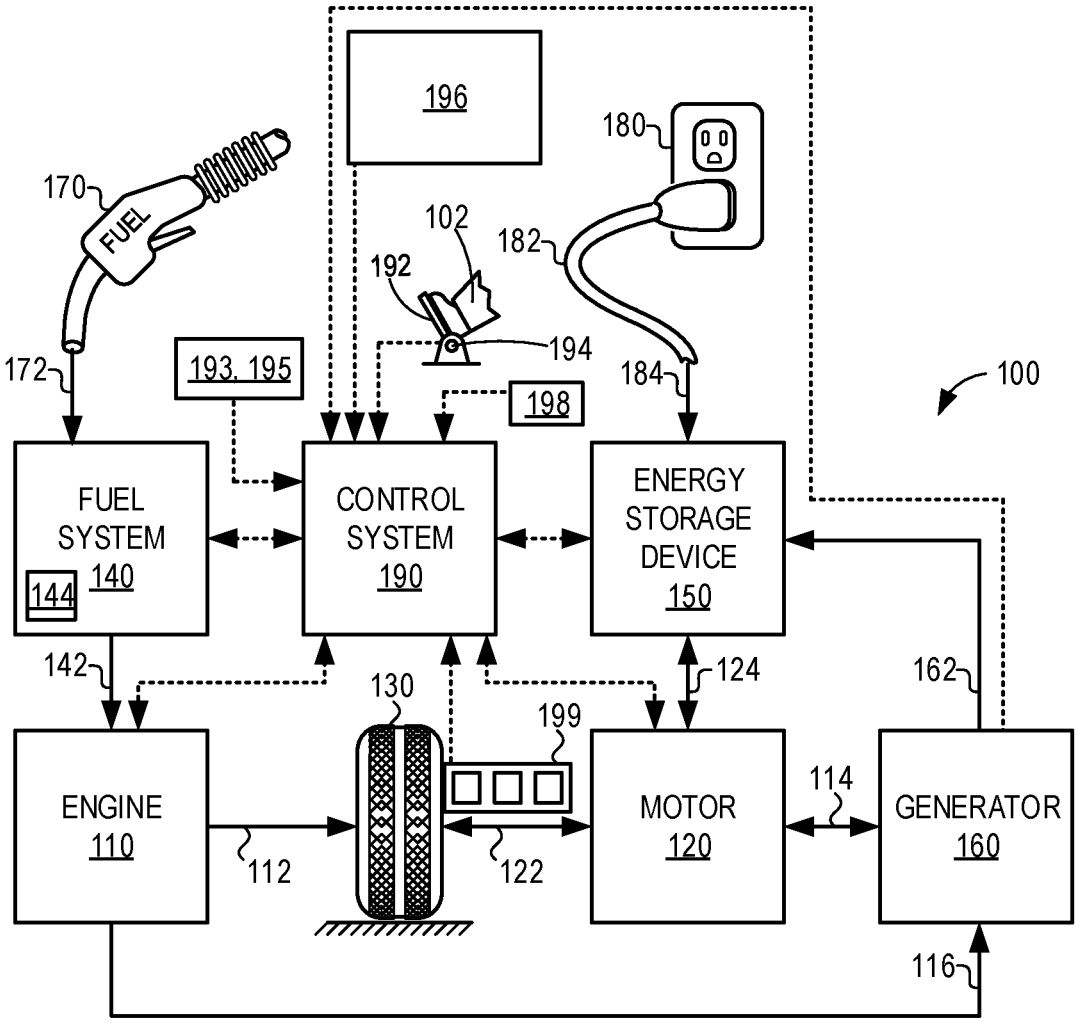
FIG. 1 shows a schematic diagram of an example vehicle propulsion system.
Figure 2:
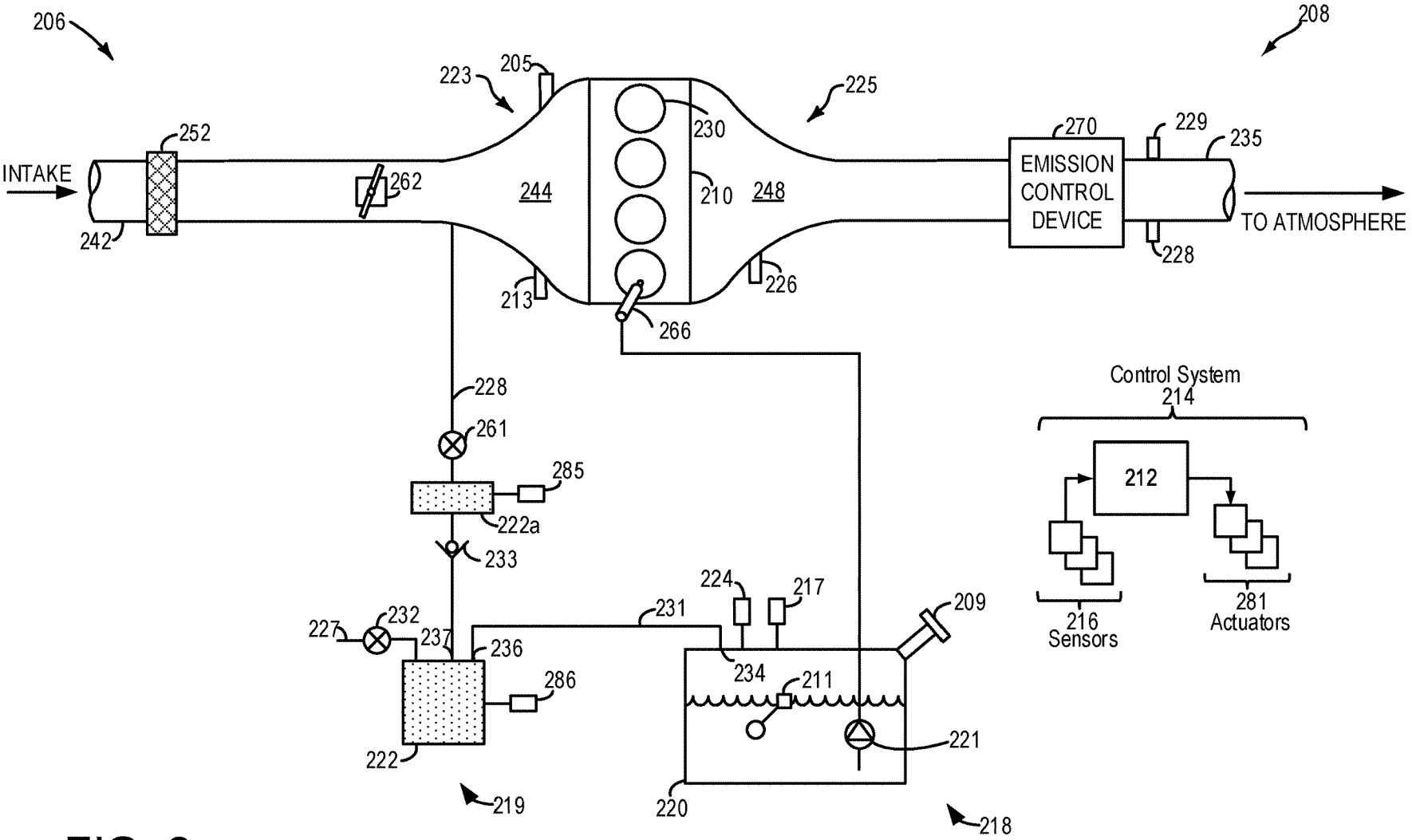
FIG. 2 shows a schematic diagram of a vehicle engine system including a fuel system and an evaporative emissions control system.

Turning now to the figures, FIG. 1 illustrates an example vehicle propulsion system 100. For example, vehicle system 100 may be a hybrid electric vehicle or a plug-in hybrid electric vehicle. However, it should be understood that, though FIG. 1 shows a hybrid vehicle system, in other examples, vehicle system 100 may not be a hybrid vehicle system and may be propelled solely via engine 110.

Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV). While FIG. 1 depicts a HEV, the description is not meant to be limiting and it may be understood that they systems and methods depicted herein may be applied to non-HEVs without departing from the scope of the present disclosure.

In some examples, vehicle propulsion system 100 may utilize a variety of different operational modes depending on operating conditions encountered by the vehicle propulsion system. Some of these modes may enable engine 110 to be maintained in an off state (i.e. set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some embodiments. However, in other embodiments, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some embodiments, motor 120 may propel the vehicle via a first set of drive wheels and engine 110 may propel the vehicle via a second set of drive wheels.

In other embodiments, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some embodiments, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, generator 160, an onboard global positioning system (GPS) 193, and onboard cameras 195. Further, control system 190 may send control signals to one or more of engine 110, motor 120, fuel system 140, energy storage device 150, generator 160, and onboard cameras 195, responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (HEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may disconnected between power source 180 and energy storage device 150. Control system 190 may identify and/or control the amount of electrical energy stored at the energy storage device, which may be referred to as the state of charge (SOC).

In other embodiments, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some embodiments, fuel tank 144 may be configured to store the fuel received from fuel dispensing device 170 until it is supplied to engine 110 for combustion. In some embodiments, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. In an alternative embodiment, the vehicle instrument panel 196 may communicate audio messages to the operator without display. Further, the sensor(s) 199 may include a vertical accelerometer to indicate road roughness. These devices may be connected to control system 190. In one example, the control system may adjust engine output and/or the wheel brakes to increase vehicle stability in response to sensor(s) 199.

FIG. 2 shows a schematic depiction of a hybrid vehicle system 206 that can derive propulsion power from engine system 208 and/or an on-board energy storage device, such as a battery system (see FIG. 1 for a schematic depiction). An energy conversion device, such as a generator (not shown), may be operated to absorb energy from vehicle motion and/or engine operation, and then convert the absorbed energy to an energy form suitable for storage by the energy storage device.

Engine system 208 may include an engine 210 having a plurality of cylinders 230. Engine 210 includes an engine intake 223 and an engine exhaust 225. Engine intake 223 includes an air intake throttle 262 fluidly coupled to the engine intake manifold 244 via an intake passage 242. Air may enter intake passage 242 via air filter 252. Engine exhaust 225 includes an exhaust manifold 248 leading to an exhaust passage 235 that routes exhaust gas to the atmosphere. Engine exhaust 225 may include one or more emission control devices 270 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 208 is a boosted engine system, the engine system may further include a boosting device, such as a turbocharger (not shown).

Engine system 208 is coupled to a fuel system 218, and evaporative emissions system 219. Fuel system 218 includes a fuel tank 220 coupled to a fuel pump 221, the fuel tank supplying fuel to an engine 210 which propels a vehicle. Evaporative emissions system 219 includes a first fuel vapor storage device **222*a*, and a second fuel vapor storage device (fuel vapor canister) 222. The first fuel vapor storage device 222***a* and the second fuel vapor storage device 222 are separated by a one-way check valve 233. One-way check valve 233 is depicted as a vacuum-actuated check valve. However, in other examples check valve 233 may comprise a solenoid valve wherein opening or closing of the valve is performed via actuation of a check valve solenoid. The fuel tank 220 further includes a fuel vapor outlet 234 connected in series to the one-way check valve 233 which is connected in series with the first fuel vapor storage device 222*a* (e.g., fuel vapor storage buffer), which in turn is connected in series to a canister purge valve 261 that is connected to the intake manifold 244. Second fuel vapor storage device 222 includes a load input (load port) 236 connected to the fuel tank 220 and a purge outlet (purge port) 237 connected to the one-way check valve 233.

During a fuel tank refueling event, fuel may be pumped into the vehicle from an external source through refueling port 209 (e.g., gas cap) coupled to the fuel tank. Fuel tank 220 may hold a plurality of fuel blends, including fuel with a range of alcohol concentrations, such as various gasoline-ethanol blends, including E10, E85, gasoline, etc., and combinations thereof. A fuel level sensor 211 located in fuel tank 220 may provide an indication of the fuel level ("Fuel Level Input") to controller 212. As depicted, fuel level sensor 211 may comprise a float connected to a variable resistor. Alternatively, other types of fuel level sensors may be used.

Fuel pump 221 is configured to pressurize fuel delivered to the injectors of engine 210, such as example injector 266. While only a single injector 266 for injecting fuel directly into one cylinder is shown, additional injectors are provided for each of the other cylinders. Further, in an alternate approach, fuel may be injected into an intake port (not shown) of each of the cylinders in a system commonly referred to as port injection. And, other types of fuel injection systems may be used where both a port injector and a direct injector are provided for each cylinder. It will be appreciated that fuel system 218 may be a return-less fuel system, a return fuel system, or various other types of fuel system. Vapors generated in fuel tank 220 may be routed to fuel vapor canister 222, via conduit 231, before being purged to the engine intake 223.

Fuel vapor canister 222 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister 222 is saturated, vapors stored in fuel vapor canister 222 (e.g., second fuel vapor storage device) may be purged to engine intake 223 by opening canister purge valve 261. During purging conditions, while canister purge valve 261 is open, vacuum-actuated check valve 233 is forced opened due to engine intake vacuum. While a single canister 222 is shown between the fuel tank 220 and the check valve 233, it will be appreciated that fuel system 218 may include any number of canisters between the fuel tank 220 and the check valve 233. In one example, canister purge valve 261 may be a solenoid valve wherein opening or closing of the valve is performed via actuation of a canister purge solenoid. Furthermore, during purging conditions, vapors stored in the first vapor storage device 222*a* may additionally be purged to engine intake 223.

First vapor storage device 222*a* may comprise a canister volume smaller than (e.g., a fraction of) second vapor storage device 222. The adsorbent in the first vapor storage device 222*a* may be same as, or different from, the adsorbent in the second vapor storage device 222 (e.g., both may include activated charcoal).

Second vapor storage device 222 includes a vent line 227 for routing gases out of the canister 222 to the atmosphere when storing, or trapping, fuel vapors from fuel tank 220. Vent line 227 may also allow fresh air to be drawn into second vapor storage device 222 and first vapor storage device 222*a* when purging stored fuel vapors to engine intake 223 via purge line 228 and purge valve 261. While this example shows vent line 227 communicating with fresh, unheated air, various modifications may also be used. Vent line 227 may include a canister vent valve 232 to adjust a flow of air and vapors between second vapor storage device 222 and the atmosphere. The canister vent valve 232 may also be used for diagnostic routines. When included, the vent valve may be opened during fuel vapor storing operations (for example, during fuel tank refueling and while the engine is not running) so that air, stripped of fuel vapor after having passed through the second vapor storage device 222, can be pushed out to the atmosphere. Likewise, during purging operations (for example, during canister regeneration and while the engine is running), the vent valve may be opened to allow a flow of fresh air to strip the fuel vapors stored in the second vapor storage device 222 and the first vapor storage device 222*a*. In one example, canister vent valve 232 may be a solenoid valve wherein opening or closing of the valve is performed via actuation of a canister vent solenoid. In particular, the canister vent valve may be in an open position that is closed upon actuation of the canister vent solenoid.

One or more pressure sensors 217 may be coupled to fuel system 218 for providing an estimate of a fuel system (and evaporative emissions system) pressure. In one example, the fuel system pressure, and in some example evaporative emissions system pressure as well, is indicated by pressure sensor 217, where pressure sensor 217 is a fuel tank pressure transducer (FTPT) coupled to fuel tank 220. While the depicted example shows pressure sensor 217 directly coupled to fuel tank 220, in alternate embodiments, the pressure sensor may be coupled between the fuel tank and second vapor storage device 222. In some examples, a vehicle control system may infer and indicate undesired evaporative emissions based on changes in a fuel tank (and evaporative emissions system) pressure during an evaporative emissions diagnostic routine, as described in further detail below.

One or more temperature sensors 224 may also be coupled to fuel system 218 for providing an estimate of a fuel system temperature. In one example, the fuel system temperature is a fuel tank temperature, wherein temperature sensor 224 is a fuel tank temperature sensor coupled to fuel tank 220 for estimating a fuel tank temperature. While the depicted example shows temperature sensor 224 directly coupled to fuel tank 220, in alternate embodiments, the temperature sensor may be coupled between the fuel tank and second vapor storage device 222, for example.

Fuel vapors released from second vapor storage device 222 and first vapor storage device 222*a*, for example during a purging operation, may be directed into engine intake manifold 244 via purge line 228. The flow of vapors along purge line 228 may be regulated by canister purge valve 261, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 212, responsive to engine operating conditions, including, for example, engine speed-load conditions, an air-fuel ratio, a canister load, etc. By commanding the canister purge valve to be closed, the controller may seal the fuel vapor recovery system (evaporative emissions control system) from the engine intake. Check valve 233 in purge line 228 may additionally prevent intake manifold pressure from flowing gases in the opposite direction of the purge flow. As such, the check valve may compensate for conditions where canister purge valve control is not accurately timed or under conditions where the canister purge valve itself can be forced open by a high intake manifold pressure.

The engine intake may include various sensors. For example, a mass air flow (MAF) sensor 205 may be coupled to the engine intake to determine a rate of air mass flowing through the intake. Further, a barometric pressure sensor 213 may be included in the engine intake. For example, barometric pressure sensor 213 may be a manifold air pressure (MAP) sensor and may be coupled to the engine intake downstream of throttle 262.

Fuel system 218 and evaporative emissions system 219 may be operated by controller 212 in a plurality of modes by selective adjustment of the various valves and solenoids. For example, the fuel system and evaporative emissions system may be operated in a fuel vapor storage mode (e.g., during a fuel tank refueling operation and with the engine not running), wherein the controller 212 may open canister vent valve 232 while closing canister purge valve (CPV) 261 to direct refueling vapors, diurnal vapors, and/or running loss vapors into second vapor storage device 222 while preventing fuel tank vapors from being directed into the first vapor storage device 222*a* or to the intake manifold.

As yet another example, the fuel system and evaporative emissions system may be operated in a canister purging mode (e.g., after an emission control device light-off temperature has been attained and with the engine running), wherein the controller 212 may open canister purge valve 261 and canister vent valve 232. Herein, vacuum generated by the intake manifold of the operating engine may be used to draw fresh air through vent line 227 and through second vapor storage device 222 and first vapor storage device 222*a* to purge the stored fuel vapors into intake manifold 244. In this mode, the purged fuel vapors from the second vapor storage device 222 and the first vapor storage device 222*a* are combusted in the engine. The purging may be continued until the stored fuel vapor amount in both the second vapor storage device 222 and the first vapor storage device 222*a* is below a threshold. During purging, the learned vapor amount/concentration can be used to determine the amount of fuel vapors stored in the vapor storage devices (e.g., 222 and 222*a*), and then during a later portion of the purging operation (when the vapor storage devices are sufficiently purged or empty), the learned vapor amount/concentration can be used to estimate a loading state of the vapor storage devices. For example, one or more oxygen sensors (e.g., 226) may be coupled to the second vapor storage device 222 and first vapor storage device 222*a* (e.g., downstream of each of the vapor storage devices), or positioned in the engine intake and/or engine exhaust, to provide an estimate of a load in each of the vapor storage devices (that is, an amount of fuel vapors stored in the first vapor storage device 222*a* and the second vapor storage device 222), or a total amount of fuel vapors stored in both the first vapor storage device and the second vapor storage device. Based on an indication of a load amount in the fuel vapor storage devices, and further based on engine operating conditions, such as engine speed-load conditions, a purge flow rate may be determined. In still further examples, one or more temperature sensors (e.g., 285, 286) may be coupled to and/or within first fuel vapor storage device 222*a* and/or second fuel vapor storage device 222, respectively. As fuel vapor is adsorbed by the adsorbent in the fuel vapor storage device(s), heat is generated (heat of adsorption). Likewise, as fuel vapor is desorbed by the adsorbent in the fuel vapor storage device (s), heat is consumed. In this way, the adsorption and desorption of fuel vapor by the fuel vapor storage devices may be monitored and estimated based on temperature changes within the fuel vapor storage device(s), and may be used to estimate a loading state in the fuel vapor storage device(s).

Vehicle system 206 may further include control system 214. Control system 214 is shown receiving information from a plurality of sensors 216 (various examples of which are described herein) and sending control signals to a plurality of actuators 281 (various examples of which are described herein). As one example, sensors 216 may include exhaust gas oxygen sensor 226 located upstream of the emission control device, temperature sensor 228, temperature sensor 224, MAP sensor 213, fuel tank pressure sensor 217, and pressure sensor 229. Other sensors such as additional pressure, temperature, air/fuel ratio, and composition sensors may be coupled to various locations in the vehicle system 206. As another example, the actuators may include fuel injector 266, canister purge valve 261, canister vent valve 232, fuel pump 221, and throttle 262.

Control system 214 may further receive information regarding the location of the vehicle from an on-board global positioning system (GPS). Information received from the GPS may include vehicle speed, vehicle altitude, vehicle position/location, etc. This information may be used to infer engine operating parameters, such as local barometric pressure. Control system 214 may further be configured to receive information via the internet or other communication networks. Information received from the GPS may be cross-referenced to information available via the internet to determine local weather conditions, local vehicle regulations, etc. Control system 214 may use the internet to obtain updated software modules which may be stored in non-transitory memory.

The control system 214 may include a controller 212. Controller 212 may be configured as a conventional microcomputer including a microprocessor unit, input/output ports, read-only memory, random access memory, keep alive memory, a controller area network (CAN) bus, etc. Controller 212 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines. An example control routine is described herein with regard to FIG. 3 and FIG. 4.

Controller 212 may also be configured to intermittently perform evaporative emissions detection routines on fuel system 218 and evaporative emissions system 219 to confirm that undesired evaporative emissions are not present in the fuel system and/or evaporative emissions system. As such, various diagnostic evaporative emissions detection tests may be performed while the engine is off (engine-off evaporative emissions test) or while the engine is running (engine-on evaporative emissions test).

Evaporative emissions tests performed while the engine is not running may include sealing the fuel system and evaporative emissions system following engine shut-off and monitoring a change in pressure. This type of evaporative emissions test is referred to herein as an engine-off natural vacuum test (EONV). In sealing the fuel system and evaporative emissions system following engine shut-off, pressure in such a fuel system and evaporative emissions control system will increase if the tank is heated further (e.g., from hot exhaust or a hot parking surface) as liquid fuel vaporizes. If the pressure rise meets or exceeds a predetermined threshold, it may be indicated that the fuel system and the evaporative emissions control system are free from undesired evaporative emissions. Alternatively, if during the pressure rise portion of the test the pressure curve reaches a zero-slope prior to reaching the threshold, as fuel in the fuel tank cools, a vacuum is generated in the fuel system and evaporative emissions system as fuel vapors condense to liquid fuel. Vacuum generation may monitored and undesired emissions identified based on expected vacuum development or expected rates of vacuum development.

Evaporative emissions tests performed while the engine is running may include applying a negative pressure on the fuel system and evaporative emissions system for a duration (e.g., until a target vacuum is reached) and then sealing the fuel system and evaporative emissions system while monitoring a change in pressure (e.g., a rate of change in the vacuum level, or a final pressure value). As discussed above, if such a test is performed during vehicle cruising conditions (e.g., steady state vehicle speed greater than 40 miles-per-hour), the test results may be difficult to interpret due to the effects of fuel volatilization during monitoring the pressure change subsequent to sealing the fuel system and evaporative emissions system. For example, the rate of change in the vacuum level, or the final pressure value may be influenced by fuel volatilization, wherein undesired evaporative emissions may be indicated even though the fuel system and evaporative emissions control system may in fact be free of undesired evaporative emissions. As such, it may be desirable to conduct the engine-on evaporative emissions test diagnostic during a cold-start event, where fuel system conditions are stable. However, as discussed above, in a vehicle system where a fuel vapor canister (e.g., second vapor storage device) includes a buffer region (e.g., first vapor storage device), and where the buffer region is positioned between a load port (e.g., 236) and a purge port (e.g., 237) of the fuel vapor canister, conducting a cold-start engine-on test may result in undesired emissions. The undesired emissions may be the result of the buffer region being loaded with fuel vapors during a vehicle-off soak condition, wherein vapors are purged to engine intake during evacuating the evaporative emissions system and fuel system during the cold-start event, and where an exhaust catalyst (e.g., 270) temperature is below a threshold temperature needed for oxidation of unburnt hydrocarbons. As such, as will be discussed in detail below, separating the first vapor storage device 222*a* from the second vapor storage device 222 by one way check valve 233 may enable an engine-on evaporative emissions test diagnostic procedure during a cold-start event without resulting in undesired tailpipe emissions.

Figure 3:
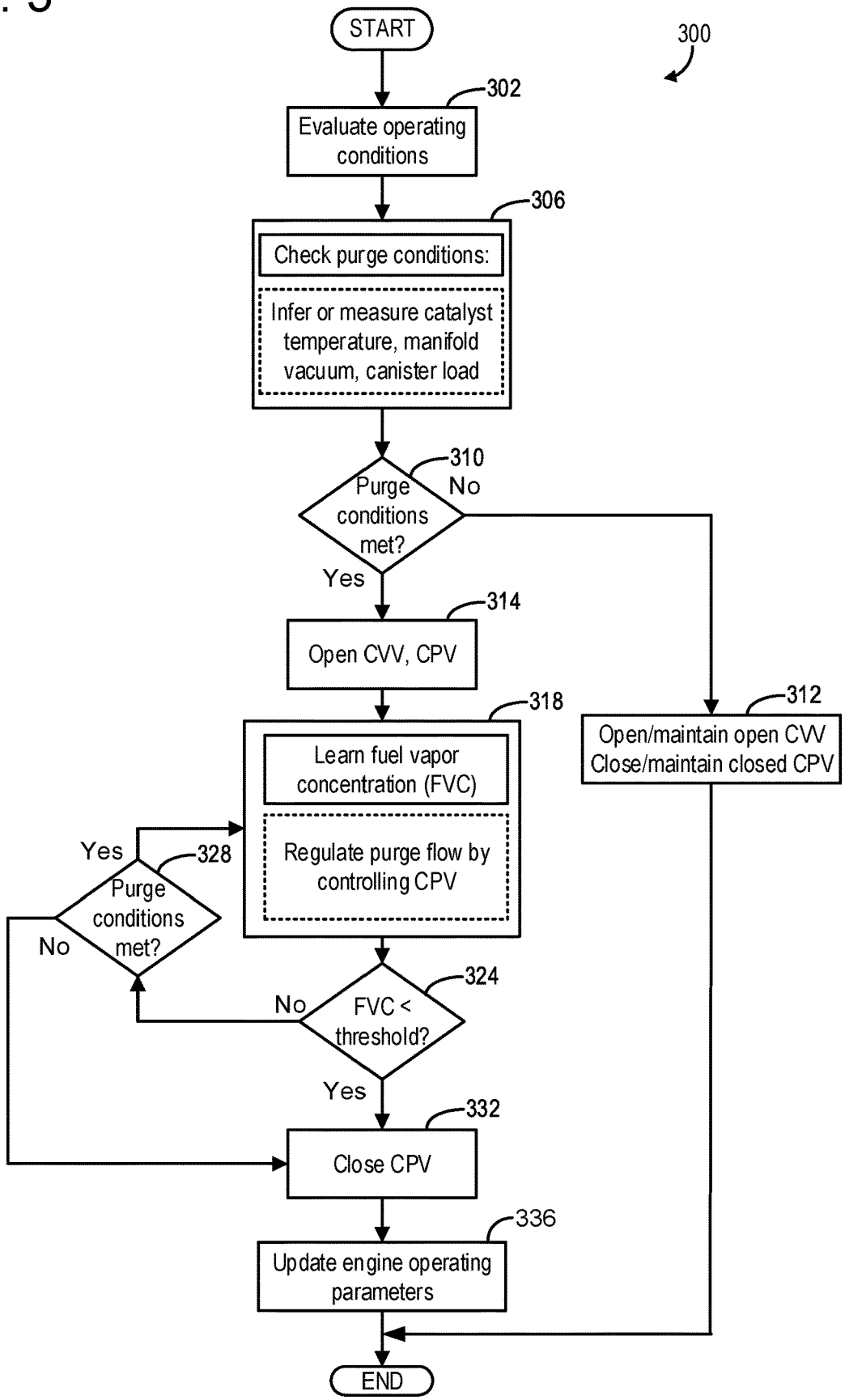
FIG. 3 shows a high level flowchart for an example method for conducting a fuel vapor canister purging operation.

Turning now to FIG. 3, a high level flowchart for an example method 300 for conducting a fuel vapor canister purging operation, is shown. More specifically, the purging operation may comprise purging fuel vapors from a fuel tank through a first vapor storage device into an intake manifold of an internal combustion engine, venting a second fuel vapor storage device to atmosphere and purging fuel vapors from the second fuel vapor storage device through the first fuel vapor storage device into the intake manifold. Method 300 will be described with reference to the systems described herein and shown in FIGS. 1-2, though it should be understood that similar methods may be applied to other systems without departing from the scope of this disclosure. Method 300 may be carried out by a controller, such as controller 212 in FIG. 2, and may be stored at the controller as executable instructions in non-transitory memory. Instructions for carrying out method 300 and the rest of the methods included herein may be executed by the controller based on instructions stored on a memory of the controller and in conjunction with signals received from sensors of the vehicle system, such as exhaust gas oxygen sensor(s) (e.g., 226), pressure sensor 213, etc., described above with reference to FIG. 1 and FIG. 2. The controller may employ fuel system and evaporative emissions system actuators such as canister purge valve (e.g., 261), canister vent valve (e.g., 232), according to the method described below.

Method 300 begins at 302 and may include evaluating operating conditions. Operating conditions may be estimated, measured, and/or inferred, and may include one or more vehicle conditions, such as vehicle speed, vehicle location, etc., various engine conditions, such as engine status, engine load, engine speed, A/F ratio, etc., various fuel system conditions, such as fuel level, fuel type, fuel temperature, etc., various evaporative emissions system conditions, such as fuel vapor canister load, fuel tank pressure, etc., as well as various ambient conditions, such as ambient temperature, humidity, barometric pressure, etc.

Proceeding to 306, method 300 may include checking whether vehicle operating conditions are such that a canister purge event may be initiated. For example, conditions that may enable a purge event may include one or more of an engine-on condition, a canister load above a threshold, an intake manifold vacuum above a threshold, an estimate or measurement of temperature of an emission control device (e.g., 270) such as a catalyst being above a predetermined temperature associated with catalytic oxidation of hydrocarbons in the exhaust commonly referred to as light-off temperature, a non-steady state engine condition, and other operating conditions that would not be adversely affected by a canister purge operation.

Accordingly, proceeding to 310, method 300 may include indicating whether canister purge conditions are met. If, at 310, it is indicated that canister purge conditions are not met, method 300 may proceed to 312. At 312, method 300 may include opening or maintaining open a canister vent valve (CVV) (e.g., 232), and closing or maintaining closed a canister purge valve (CPV) (e.g., 261). With the CVV open and the CPV closed, a second fuel vapor storage device (e.g., 222) may be vented to atmosphere, wherein fuel vapors from the fuel tank may be routed through the second fuel vapor storage device but not through a first fuel vapor storage device (e.g., 222*a*). Such an example may include an engine-on condition wherein one or more of canister load is indicated to be below a threshold, intake manifold vacuum is indicated to be below a threshold, or a catalyst is indicated to be below a light-off temperature, as discussed above. With the CVV open and the CPV closed, running loss vapors may be directed to the second fuel vapor storage device for adsorption prior to exiting to atmosphere. Another example may include a vehicle-on condition, wherein the engine is off and the wherein the vehicle is being propelled solely by battery power. Still another example may include a vehicle-off condition wherein the vehicle is parked for a duration, wherein an open CVV and a closed CPV may thus direct fuel vapors generated due to a diurnal temperature fluctuations from the fuel tank to the second fuel vapor storage device for adsorption prior to exiting to atmosphere. A still further example may include a refueling event where the engine is in an off-state, wherein during refilling of the fuel tank through a gas cap (e.g., 209) an open CVV and a closed CPV may thus direct vapors generated from the refueling event to the second fuel vapor storage device for storage therein prior to exiting to atmosphere.

Returning to 310, if it is indicated that purge conditions are met, method 300 may proceed to 314. At 314, method 300 may include opening or maintaining open the CVV, and commanding open the CPV. Accordingly, with the CPV and the CVV open, vapors from the fuel tank may be purged through the first fuel vapor storage device (e.g., 222*a*) into the intake manifold of the internal combustion engine, and with the second fuel vapor storage device vented to atmosphere, fuel vapors from the second vapor storage device (e.g., 222) may be purged through the first storage device into the intake manifold.

Continuing at 318, method 300 may include learning a fuel vapor concentration (FVC) resulting from the purge event. In one example, learning the fuel vapor concentration may include the steps of indicating an air/fuel ratio via, for example, a proportional plus integral feedback controller coupled to a two-state exhaust gas oxygen sensor, and responsive to the air/fuel indication and a measurement of inducted air flow, generating a base fuel command. The CPV may be controlled in order to purge the fuel vapors at a substantially constant rate over a range of engine operating conditions, wherein fuel vapor content in the purged fuel vapor mixture may be measured by subtracting a reference air/fuel ratio, related to engine operation without purging, from the air/fuel ratio indication to generate an air/fuel ratio error (compensation factor). As such, the compensation factor may represent a learned value directly related to fuel vapor concentration, and may be subtracted from the base fuel command to correct for the induction of fuel vapors. The duration of the purging operation may be based on the learned value of the vapors such that when it is indicated there are no appreciable hydrocarbons in the vapors (the compensation is essentially zero), the purge may be ended.

Accordingly, continuing at 324, method 300 includes indicating whether the FVC from the purging event is below a threshold concentration. In other words, it may be indicated whether vapors being purged from the first fuel vapor storage device, from the fuel tank through the first vapor storage device, and from the second fuel vapor storage device through the first fuel vapor storage device, are below a threshold. In some examples, the threshold concentration may be an indication that the fuel tank, second fuel vapor storage device, and first fuel vapor storage device, are all free or nearly free (substantially absent) of fuel vapors. Accordingly, at 324, if it is indicated that the FVC is not below the threshold concentration, method 300 may proceed to 328 and may include indicating whether purge conditions are still met. For example, if an engine-off event is indicated, then purging conditions may not be met. In another example, intake manifold vacuum may change to a level that is not conducive to a purging event. For example, a vehicle operator accelerating the vehicle by pressing down on a gas pedal may thus result in a throttle opening, which may decrease the amount of intake manifold vacuum for the purging process. As such, at 328, if purging conditions are still met, method 300 may continue learning fuel vapor concentration and regulating purge flow by controlling the CPV during the purge event. However, if at 328 it is indicated that purge conditions are not met, method 300 may proceed to 332 and may include commanding closed the CPV to end the purge event. Following the closing of the CPV, method 300 may thus proceed to 336 wherein engine operating parameters are updated. For example, at 336, updating engine operating parameters may include updating a canister purge schedule to indicate that a purge event was initiated by not completed, and may thus additionally include updating a loading state of the second fuel vapor storage device and the first fuel vapor storage device based on the FVC at the time of closing the CPV. Method 300 may then end.

Returning to 324, responsive to FVC below the threshold, method 300 may proceed to 332 and may include similarly closing the CPV to end the purge event. Following closing of the CPV, method 300 may thus proceed to 336 wherein engine operating parameters are updated. Updating engine operating parameters may include updating a canister purge schedule to indicate that a purge event was initiated and completed, and may additionally include updating a loading state of the second fuel vapor storage device and the first fuel vapor storage device based on the completed purge event. Method 300 may then end.

Figure 4:
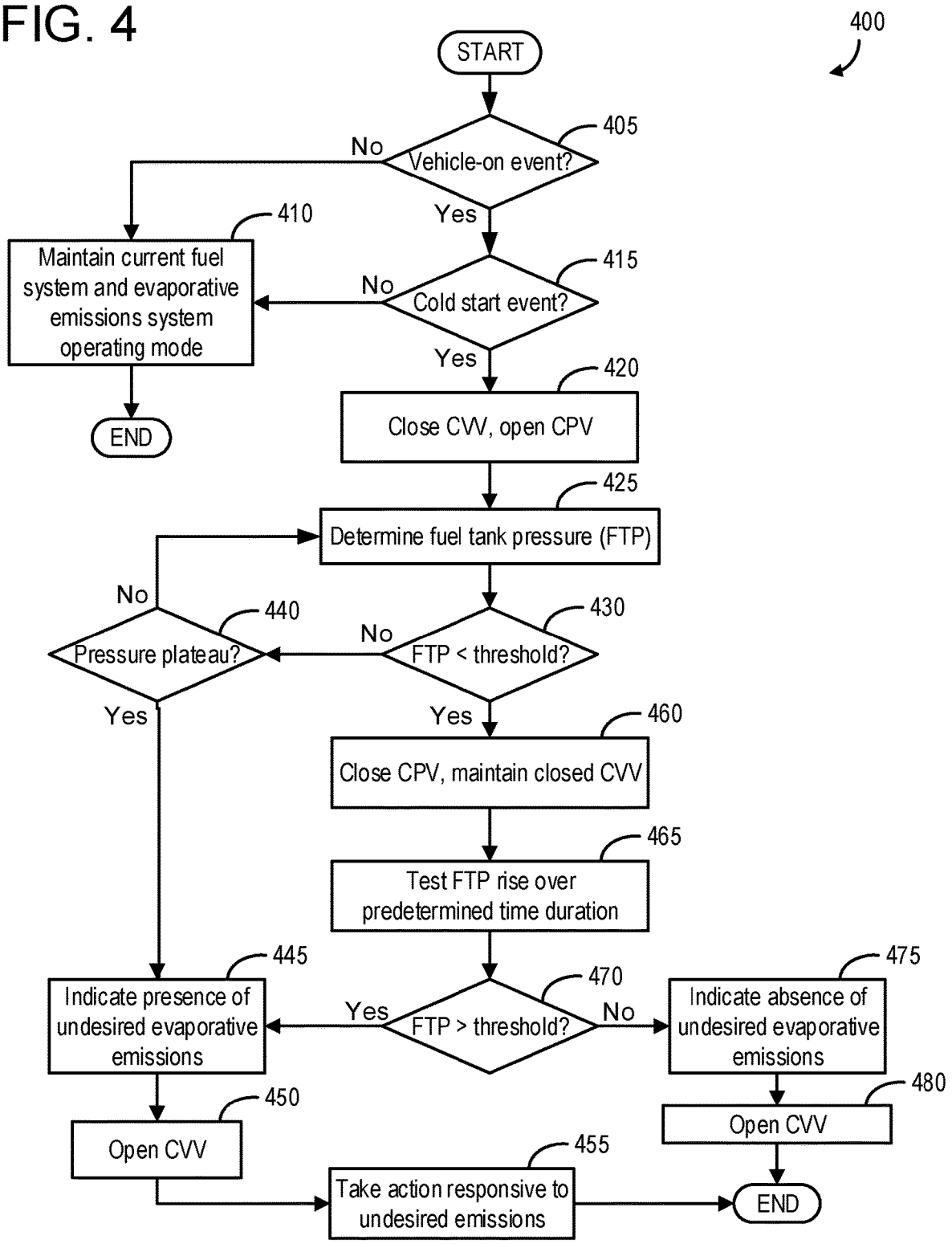
FIG. 4 shows a high level flowchart for conducting an evaporative emissions test diagnostic procedure during a cold-start event.
Figure 5:
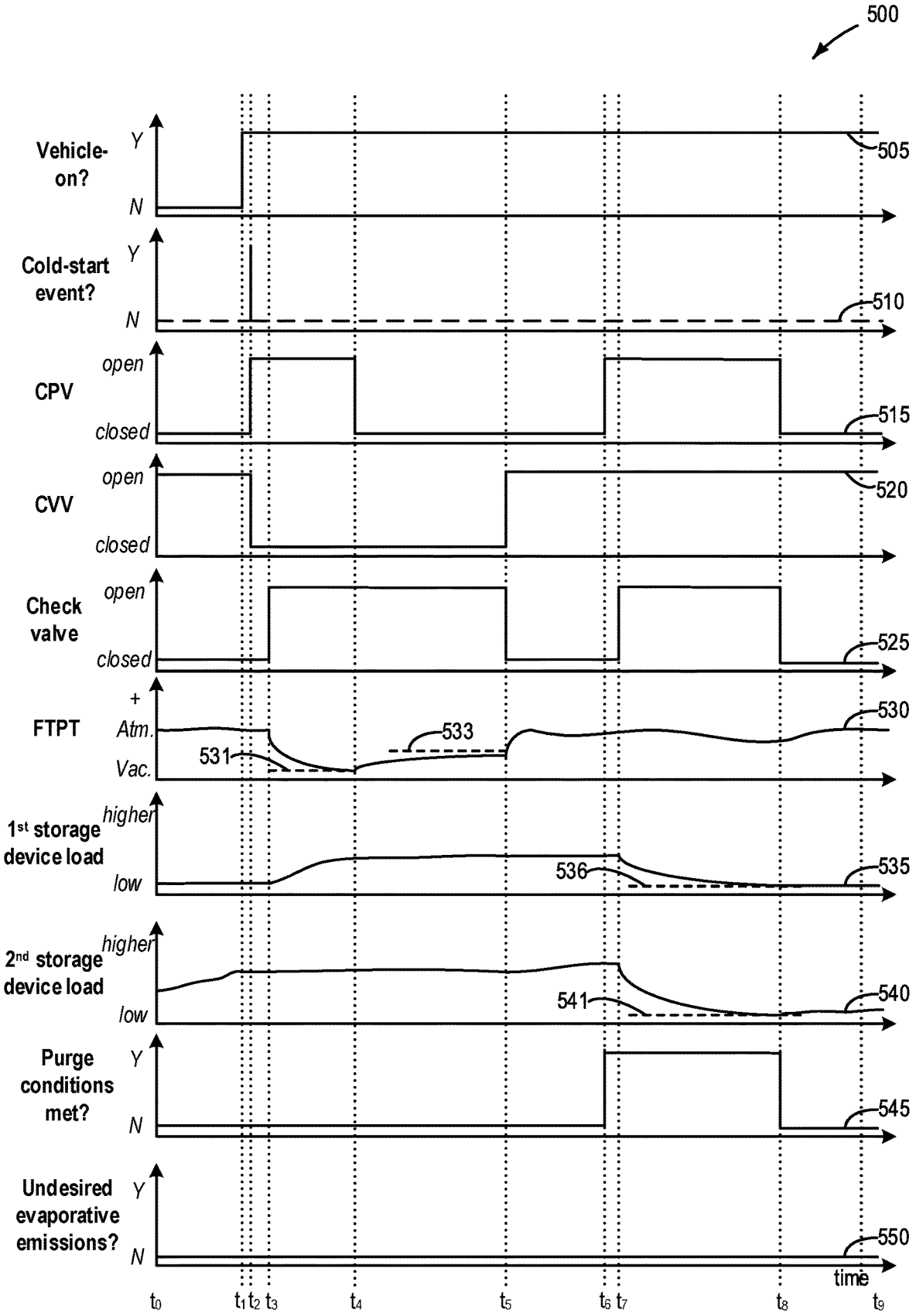
FIG. 5 shows an example timeline illustrating an evaporative emissions test diagnostic procedure during a cold-start event according to the method depicted in FIG. 4, and a fuel vapor canister purging operation according to the method depicted in FIG. 3.

Turning now to FIG. 4, a high level flow chart for an example method 400 for conducting an engine-on evaporative emissions test diagnostic, is shown. More specifically, method 400 may be used to conduct an evaporative emissions test diagnostic during cold-start conditions wherein a catalytic converter is at a temperature below that needed for catalytic activity. Such a method may comprise starting the engine, sealing a canister vent valve (CVV) (e.g. 232), commanding open a canister purge valve (CPV) (e.g., 261) until a predetermined negative pressure is reached in a vehicle fuel tank, and, after the predetermined negative pressure is reached, close the CPV and indicate undesired evaporative emissions are present if fuel tank pressure exceeds a threshold pressure within a predetermined time after closing the CPV. Method 400 will be described with reference to the systems described herein and shown in FIG. 1 and FIG. 2, though it should be understood that similar methods may be applied to other systems without departing from the scope of this disclosure. Method 400 may be carried out by a controller, such as controller 212 in FIG. 2, and may be stored at the controller as executable instructions in non-transitory memory. Instructions for carrying out method 400 and the rest of the methods included herein may be executed by the controller based on instructions stored on a memory of the controller and in conjunction with signals received from sensors of the engine system, such as the sensors described above with reference to FIG. 1 and FIG. 2. The controller may employ fuel system and evaporative emissions system actuators, such as canister purge valve (e.g., 261), canister vent valve (e.g., 232), etc., according to the method below.

Method 400 begins at 405 and may include indicating whether a vehicle-on event is indicated. For example, a vehicle-on event may include a key-on event, a remote start event, or any event whereby the vehicle transitions from an off-state to an on-state. If a vehicle-on event is not indicated, method 400 may proceed to 410 and may include maintaining the vehicle fuel system and evaporative emissions control system in a second operating mode, where the second operating mode may comprise routing fuel vapors from a vehicle fuel tank through a second fuel vapor storage device (e.g., 222), but not through a first fuel vapor storage device (e.g., 222*a*). Such an operating mode may be enabled by maintaining open a canister vent valve (CVV) (e.g. 232) and maintaining closed a canister purge valve (CPV) (e.g., 261), for example. With the CVV open, the second fuel vapor storage device may be vented to atmosphere. Furthermore, a vacuum-actuated one-way check valve (e.g., 233) positioned between the second fuel vapor storage device and the first fuel vapor storage device may be maintained in a closed conformation, thus preventing vapors from the fuel tank from being routed through the first fuel vapor storage device.

If, at 405, a vehicle-on event is indicated, method 400 may proceed to 415. At 415, method 400 may include indicating whether the vehicle start event comprises a cold start. For example, at 415, indicating an engine cold start may include engine temperature or engine coolant temperature being lower than a threshold temperature (such as a catalyst light-off temperature). In another example, an engine cold start may include an indication of an ambient temperature below a preset temperature for a predetermined time. In still another example, at 415, a temperature of fuel in the fuel tank may be estimated, for example via a fuel tank temperature sensor (e.g., 224) coupled to the fuel tank, a fuel level may be indicated, for example via a fuel level sensor (e.g., 211), and a fuel type (fuel blend) may be indicated. Based on the fuel temperature, fuel tank fill level, and fuel type, fuel volatility may be indicated. Fuel volatility above a threshold may complicate interpretation of results from an evaporative emissions test diagnostic wherein a fuel system and evaporative emissions system are first evacuated and then sealed, and wherein pressure bleed-up is monitored to indicate the presence or absence of undesired evaporative emissions. For example, as described above, fuel volatility above a threshold may result in pressure-bleed up which may be interpreted as undesired evaporative emissions, when in fact the fuel system and evaporative emissions system are free from undesired evaporative emissions. Accordingly, if fuel volatility is above a threshold, a cold start of the engine may not be indicated. As such, at 415 if engine temperature or engine coolant temperature is below a threshold temperature, if an ambient temperature is below a preset temperature for a predetermined time, or if fuel volatility is above a threshold, then a cold start event may not be indicated. Accordingly, if a cold start event is not indicated, method 400 may proceed to 410, and may include maintaining the vehicle fuel system and evaporative emissions system in the second operating mode, as described above. For example, as a cold start event is not indicated, an evaporative emissions test diagnostic may not be conducted. As such, the fuel system and evaporative emissions system may be maintained in the second operating mode to route fuel vapors from the fuel tank through the second fuel vapor storage device (e.g., 222), but not through the first fuel vapor storage device (e.g., 222*a*), as discussed above.

If, at 415, a cold start event is indicated, method 400 may proceed to 420. At 420, method 400 may include commanding closed the CVV (e.g., 232) and commanding open the CPV (e.g., 261). Such a configuration may comprise operating the vehicle fuel system and evaporative emissions system in a first operating mode, and may include routing fuel vapors from a fuel tank through the first fuel vapor storage device into an intake manifold of the internal combustion engine. By commanding closed the CVV, the second fuel vapor storage device may not be vented to atmosphere during the first operating mode, and accordingly, fuel vapors from the fuel tank and not from the second fuel vapor canister may be routed through the first vapor storage device into the intake manifold during the first operating mode. Operating the vehicle fuel system and evaporative emissions system in the first operating mode thus serves to evacuate the vehicle fuel system and evaporative emissions system utilizing intake manifold vacuum in order to conduct an evaporative emissions test diagnostic procedure. With the first fuel vapor storage device (e.g., 222*a*) and the second fuel vapor storage device (e.g., 222) separated by a one-way vacuum-actuated check valve (e.g., 233), during vehicle-off conditions, fuel vapors from the fuel tank may not load the first fuel vapor storage device with vapors. Accordingly, as a purging event (depicted in FIG. 3) is typically initiated during a drive cycle prior to a vehicle shut-down event, the first fuel vapor storage device (e.g., 222*a*) is likely to be clean responsive to a vehicle-on event, as fuel vapors are prevented from loading the first fuel vapor storage device during vehicle-off conditions (or engine-off conditions). As such, by operating the fuel system and evaporative emissions system in the first operating mode to evacuate the fuel system and evaporative emissions system in order to conduct an evaporative emissions test diagnostic, fuel vapors routed from the fuel tank toward the intake manifold may be captured and stored by the clean first fuel vapor storage device, rather than being routed to the intake manifold. Accordingly, during a cold start event, where an exhaust catalyst is below a threshold temperature sufficient to oxidize hydrocarbons in the exhaust, fuel vapors may not be inducted into the engine, thus reducing undesired emissions during such a test diagnostic.

With the CVV closed and the CPV open, method 400 may proceed to 425, and may include determining fuel tank pressure (FTP). For example, determining FTP at 425 may comprise indicating FTP via a fuel tank pressure transducer (e.g., 217). Proceeding to 430, method 400 may include indicating whether FTP is below a preset negative pressure. For example, conducting the evaporative emissions test diagnostic procedure may include routing fuel vapors from the fuel tank through the first fuel vapor storage device (e.g., 222*a*) into the intake manifold of the engine until a negative pressure in the fuel tank reaches a preset negative pressure threshold (predetermined threshold). If, at 430, it is indicated that FTP is not below the preset negative pressure threshold, method 400 may proceed to 440. At 440, it may be indicated whether pressure in the fuel tank has reached a pressure plateau. For example, during evacuating the fuel system and evaporative emissions system, if the preset negative pressure threshold is not reached, yet vacuum in the fuel tank is not indicated to be increasing, then it may be determined that the intake manifold vacuum is unable to reduce pressure in the fuel tank to the present negative pressure threshold. Such a condition may be the result of undesired evaporative emissions present in the fuel system and/or evaporative emissions system, for example. Accordingly, if a pressure plateau is indicated at 440, method 400 may proceed to 445. At 445, method 400 may include indicating the presence of undesired evaporative emissions in the fuel system and/or evaporative emissions system. As such, method 400 may proceed to 450, and may include commanding open the CVV. In other words, the fuel system and evaporative emissions system may be returned to the second operating mode, comprising venting the second storage device (e.g., 222) to atmosphere and routing fuel vapors from the fuel tank through the second fuel vapor storage device but not through the first fuel vapor storage device (e.g., 222*a*).

Proceeding to 455, method 400 may include taking an action responsive to the indicated presence of undesired evaporative emissions in the fuel system/evaporative emissions control system. In one example, taking an action may include illuminating a malfunction indicator light (MIL) on a vehicle dashboard in order to alert a vehicle operator of the need to service the vehicle. In another example, taking an action may additionally include updating a canister purge schedule based on the indication of undesired evaporative emissions. For example, canister purge operations may be scheduled to be conducted more frequently, such that vapors in the fuel system and/or evaporative emissions system may be purged to engine intake for combustion, rather than being released to atmosphere. Method 400 may then end.

Returning to 430, if it is indicated that FTP has reached the preset negative pressure threshold, method 400 may proceed to 460. At 460, method 400 may include commanding closed the CPV, and maintaining closed the CVV. By commanding closed the CPV while maintaining closed the CVV, the intake manifold may be decoupled from the fuel tank, while continuing to seal the fuel tank and the second fuel vapor storage device from atmosphere. Proceeding to 465, method 400 may include monitoring a FTP bleed-up (rise) over a predetermined time duration. As discussed above, monitoring FTP may be conducted via a fuel tank pressure transducer (e.g., 217). Furthermore, because the evaporative emissions test diagnostic is conducted during a cold-start event, wherein a first vapor storage device (e.g., 222*a*) is separated from a second fuel vapor storage device (e.g., 222) by a vacuum-actuated check valve (e.g., 233), potential issues related to fuel vaporization effects during the pressure bleed-up may be avoided. Accordingly, proceeding to 470, method 400 may include indicating whether FTP is greater than a threshold. In one example, the threshold may comprise a predetermined threshold, wherein if pressure in the fuel system and evaporative emissions system reaches the predetermined threshold during the predetermined time duration, then undesired evaporative emissions may be indicated. In another example, the predetermined threshold may comprise a pressure increase (bleed-up) rate, wherein, if the bleed-up rate is greater than the predetermined bleed-up rate, then undesired evaporative emissions may be indicated. Accordingly, at 470, if FTP is indicated to be above the predetermined threshold, or if the FTP bleed-up rate is greater than the predetermined FTP bleed-up rate, method 400 may proceed to 445. At 445, as discussed above, method 400 may include indicating the presence of undesired evaporative emissions in the fuel system and/or evaporative emissions system. As such, method 400 may proceed to 450, and may include commanding open the CVV, thus returning the fuel system and evaporative emissions system to the second operating mode.

Proceeding to 455, method 400 may include taking an action responsive to the indicated presence of undesired evaporative emissions in the fuel system/evaporative emissions control system, as discussed above. For example, a MIL on a vehicle dashboard may be illuminated to alert the vehicle operator of the need to service the vehicle. Another example may additionally include updating a canister purge schedule based on the indication of undesired evaporative emissions. For example, canister purge operations may be scheduled to be conducted more frequently, such that vapors in the fuel system and/or evaporative emissions system may be purged to engine intake for combustion, rather than being released to atmosphere. Method 400 may then end.

Returning to 470, if it is indicated that FTP is not greater than the predetermined threshold over the predetermined time duration for conducting the test diagnostic, or if the FTP bleed-up rate is not greater than the predetermined FTP bleed-up rate, method 400 may proceed to 475, and may include indicating the absence of undesired evaporative emissions. For example, the passing result may be updated at the vehicle controller, and an evaporative emissions test schedule may be updated based on the passing result. Proceeding to 480, method 400 may include commanding open the CVV. As such, the fuel system and evaporative emissions system may be returned to the second operating mode, comprising venting the second storage device (e.g., 222) to atmosphere and routing fuel vapors from the fuel tank through the second fuel vapor storage device but not through the first fuel vapor storage device (e.g., 222*a*). Method 400 may then end.

FIG. 5 depicts an example timeline 500 for conducting an engine-on evaporative emissions test diagnostic procedure, and a purging event, using the methods described herein and with reference to FIG. 3 and FIG. 4, and using the systems described herein and with reference to FIG. 1 and FIG. 2. Timeline 500 includes plot 505, indicating whether a vehicle is in an on (Y) or off (N) state, over time. Timeline 500 further includes plot 510, indicating whether an engine cold start is indicated (Y) or not (N), over time. Timeline 500 further includes plot 515, indicating whether a canister purge valve (CPV) (e.g., 261) is in an open or closed position, and plot 520, indicating whether a canister vent valve (CVV) (e.g., 232) is in an open or closed position, over time. Timeline 500 further includes plot 525, indicating whether a vacuum-actuated one-way check valve, positioned between a first fuel vapor storage device (e.g., 222*a*) and a second fuel vapor storage device (e.g., 222), is in an open or closed position, over time. Timeline 500 further includes plot 530, indicating pressure in a fuel system (e.g., 218) and evaporative emissions control system (e.g., 219), via for example, a fuel tank pressure transducer (FTPT) (e.g., 217), over time. Line 531 represents a preset negative pressure threshold, which, if reached during evacuating the fuel system and evaporative emissions control system for an evaporative emissions test procedure, may result in sealing the evaporative emissions system and fuel system from engine intake and atmosphere, and monitoring pressure bleed-up. Accordingly, line 533 represents a pressure threshold wherein, if reached during a predetermined time duration while the fuel system and evaporative emissions system are sealed from engine intake and atmosphere to conduct the evaporative emissions test diagnostic, may indicate the presence of undesired evaporative emissions. Timeline 500 further includes plot 535, indicating a canister load in the first fuel vapor storage device (e.g., 222*a*), over time. Line 536 represents a predetermined load threshold indicating that a fuel vapor concentration in the first fuel vapor storage device is substantially absent. Timeline 500 further includes plot 540, indicating a canister load in the second fuel vapor storage device (e.g., 222), over time. Line 541 represents a predetermined load threshold indicating that a fuel vapor concentration in the second fuel vapor storage device is substantially absent. It may be understood that depicting the first and second fuel vapor storage devices separately in timeline 500 is for illustrative purposes in order to emphasize different ways in which the fuel vapor storage devices may be differentially loaded/purged. In one example, temperature sensors (e.g., 285, 286), may be positioned within the first fuel vapor storage device and/or the second fuel vapor storage device in order to indicate a loading state of each of the fuel vapor storage devices individually. However, in other examples, temperature sensors may not be included in the fuel vapor storage devices, and an overall load may thus be determined via an oxygen sensor positioned, for example, in the exhaust manifold of the engine or elsewhere in the vehicle system, as discussed above. Timeline 500 further includes plot 545, indicating whether purge conditions are met, over time. Timeline 500 further includes plot 550, indicating whether undesired evaporative emissions are indicated, over time.

At time t0, the vehicle is not in operation, as indicated by plot 505. As the vehicle is not indicated to be on, a cold start event is not indicated, as illustrated by plot 510. With the vehicle in an off state, the CPV is closed, illustrated by plot 515, the CVV is open, illustrated by plot 520, and the one-way check valve, illustrated by plot 525, is closed. As such, the vehicle fuel system and evaporative emissions system may be operating in a second operating mode, wherein the second fuel vapor storage device (e.g., 222) is vented to atmosphere, and wherein fuel vapors from the fuel tank are routed through the second fuel vapor storage device, but not through the first fuel vapor storage device (e.g., 222*a*). Accordingly, with the second fuel vapor storage device vented to atmosphere, pressure in the fuel tank is near atmospheric pressure (Atm.), illustrated by plot 530. First fuel vapor storage device vapor load is low, as indicated by plot 535, likely the result of a purge event during a previous drive cycle prior to the current vehicle-off condition. However, at time t0, second fuel vapor storage device vapor load is not low, indicated by plot 540. While a purging event may have cleaned the second fuel vapor storage device during the previous drive cycle, while the fuel system and evaporative emissions system are operated in the second operating mode during the vehicle-off condition, fuel vapors from the fuel tank may be routed to the second fuel vapor storage device, thus increasing the indicated load. Furthermore, as the vehicle is in an off-state, purge conditions are not met, as illustrated by plot 545, and undesired evaporative emissions are not indicated, illustrated by plot 550.

Between time t0 and t1, while the fuel system and evaporative emissions system are operated in the second operating mode, fuel vapors from the tank continue to load the second fuel vapor storage device, indicated by plot 540. At time t1*a* vehicle-on event is indicated, illustrated by plot 505. Such a vehicle-on event may comprise a key-on event, a remote start event, etc. as described above. Accordingly, between time t1 and t2, it may be indicated whether a cold-start of the engine is indicated. As described above with regard to FIG. 4, a cold start event may comprise an engine temperature or engine coolant temperature lower than a threshold temperature (e.g., catalyst light-off temperature), ambient temperature below a preset temperature for a predetermined time, and/or fuel volatility below a threshold. Accordingly, at time t2, an engine cold start is indicated. As such, an opportunistic evaporative emissions test diagnostic may be performed, as during a cold start event, interpretation of the results of an evaporative emissions test may not be complicated by fuel vaporization issues, as discussed above. Furthermore, because the vehicle system comprises a first fuel vapor storage device and a second fuel vapor storage device separated by a vacuum-actuated one-way check valve, evacuating the fuel system and evaporative emissions system to conduct the evaporative emissions test procedure may not result in undesired emissions from the exhaust during a cold start event. Accordingly, at time t2, the CPV is commanded open, and the CVV is commanded closed. Between time t2 and t3, vacuum builds in the evaporative emissions system between the intake manifold and the one-way check valve (e.g., 233). When vacuum overcomes the one-way check valve, the valve opens, at time t3. With the CPV open, the CVV closed, and the one-way check valve open, it may be understood that the fuel system and evaporative emissions system is operating in a first operating mode. In such an operating mode, as discussed above, fuel vapors may be routed from the fuel tank through the first fuel vapor storage device into the intake manifold, and fuel vapors may not be routed from the second fuel vapor storage device to the intake manifold. However, because fuel vapors are routed from the fuel tank through the first fuel vapor storage device, fuel tank vapors may be captured and stored in the first fuel vapor storage device during evacuating the fuel system and evaporative emissions system. As such, between time t3 and t4, vacuum builds in the fuel system and evaporative emissions system, as indicated by plot 530, and a first fuel vapor storage device load increases. However, because vapors are not purged from the second fuel vapor storage device, the second fuel vapor storage device load remains unchanged.

At time t4, the preset negative pressure threshold, represented by line 531, is reached. As the preset negative pressure threshold is reached, the fuel system and evaporative emissions system may be sealed from engine intake and atmosphere, and a pressure bleed-up may be monitored in order to indicate the presence or absence of undesired evaporative emissions. Accordingly, at time t4, the CPV is commanded closed, and the CVV is maintained closed. The check valve is held open by the vacuum in the sealed fuel system and evaporative emissions system.

Between time t4 and t5, pressure in the fuel system and evaporative emissions system is monitored by, for example fuel tank pressure transducer (e.g., 217). Pressure bleed-up between time t4 and t5 does not reach the predetermined pressure threshold, represented by line 533. It may be understood that the time duration between time t4 and t5 may represent a predetermined time duration for conducting the pressure bleed-up phase of the evaporative emissions test diagnostic procedure. As the pressure bleed-up did not reach the predetermined pressure threshold between time t4 and t5, undesired evaporative emissions are not indicated, as illustrated by plot 550.

With the evaporative emissions test diagnostic procedure completed, the CVV is commanded open at time t5. By commanding open the CVV, vacuum in the fuel system and evaporative emissions system may be vented to atmosphere, thus the vacuum-actuated check valve rapidly closes, indicated by plot 525. Furthermore, between time t5 and t6, pressure in the fuel system and evaporative emissions system returns to atmospheric pressure, indicated by plot 530.

Between time t5 and t6, it may be understood that the vehicle is operating with the engine driving the vehicle, and with the CVV open, the CPV closed, and the check valve closed, it may also be understood that the fuel system and evaporative emissions system are operating in the second operating mode, where fuel vapors from the fuel tank may be routed through the second vapor storage device (e.g., 222), but not through the first fuel vapor storage device (e.g., 222*a*). As such, the vapor load in the first fuel vapor storage device remains constant between time t5 and t6, while the vapor load in the second fuel vapor storage device rises slightly due to fuel vapors from the fuel tank being captured in the second fuel vapor storage device.

At time t6, purge conditions are indicated to be met. As described above, conditions that may enable a purge event may include one or more of an engine-on condition, an indicated load of one or more fuel vapor storage devices above a threshold, an indication that an emissions control device (e.g., 270) is above a predetermined temperature associated with catalytic oxidation of hydrocarbons in the exhaust, a non-steady state engine condition, etc. As purge conditions are met at time t6, the CPV is commanded open, illustrated by plot 515. Furthermore, the CVV is maintained open, indicated by plot 520. As discussed above, with the CPV open, intake manifold vacuum builds between the check valve and the intake manifold, resulting in check valve opening at time t7. With the check valve open, the CPV open, and the CVV open, fuel vapors may be purged from the fuel tank through the first fuel vapor storage device to the intake manifold, and from the second fuel vapor storage device through the first fuel vapor storage device, to the intake manifold. Accordingly, vapor load in the first fuel vapor storage device and the second fuel vapor storage device decreases, indicated by plot 535 and 540, respectively. As discussed above, during purging, a learned fuel vapor concentration may be determined, and the purging event may be discontinued responsive to the fuel vapor concentration in the first fuel vapor storage device and the second fuel vapor storage device falls below a predetermined threshold level, or in other words, when the fuel vapor concentration resulting from the purge event is substantially absent. For illustrative purposes, line 536 is shown, representing a level of vapors indicating the first fuel vapor storage device is substantially free of fuel vapors, and line 541 is shown, representing a level of fuel vapors indicating the second fuel vapor storage device is substantially free of fuel vapors. In some examples, a temperature sensor may optionally be included in each of the fuel vapor storage devices, as discussed above, such that a load can be directly estimated based on the temperature change indicated in each fuel vapor storage device during purging. However, it may be understood that in other examples, an exhaust gas sensor may be utilized in order to indicate an overall fuel vapor concentration in the fuel vapor storage devices, based on a learned fuel vapor concentration, discussed in detail above. By illustrating both the first fuel vapor storage device and the second fuel vapor storage device separately, it is emphasized that both the first and second fuel vapor storage devices are purged together during the purging operation.

At time t8, the purging event is discontinued, as the fuel vapor storage devices are substantially free of fuel vapors. As such, the CPV is commanded closed. By commanding closed the CPV, with the CVV open, the vacuum-actuated check valve rapidly closes, indicated by plot 525. With the CPV closed, the check valve closed, and the CVV open, it may be understood that the evaporative emissions system and fuel system are being operated in the second operating mode, where fuel vapors may be routed from the fuel tank to the second fuel vapor storage device, but not to the first storage device, as discussed above. As such, between time t8 and t9, while vehicle operation continues, fuel vapor load in the first vapor storage device is maintained constant, while the fuel vapor load in the second vapor storage device is indicated to slightly rise.

In this way, an evaporative emissions test diagnostic procedure may be conducted during a vehicle engine cold start event without increasing undesired exhaust emissions as a result of an exhaust catalyst temperature being below a temperature required for catalytic activity during the cold start event. By conducting the evaporative emissions test diagnostic procedure during a cold start event, the results of such a test may not be complicated by the effects of fuel vaporization during the testing procedure, thus reducing the potential for falsely indicating undesired evaporative emissions in a fuel system and/or evaporative emissions control system that is free from undesired evaporative emissions.

The technical effect is to separate a first fuel vapor storage device from a second fuel vapor storage device by a one-way vacuum-actuated check valve. By doing so, during refueling events, other engine-off conditions, and/or vehicle-off conditions, fuel vapors from the fuel tank may be directed to the second fuel vapor storage device without being directed to the first fuel vapor storage device. Then, when a cold start event is indicated, fuel vapors may be routed from the fuel tank through the first fuel vapor canister where they may be adsorbed, prior to being routed to an intake manifold of the engine. Furthermore, during the cold start event, vapors may not be routed from the second fuel vapor storage device to the intake manifold. As such, intake manifold vacuum may be utilized to evacuate a vehicle fuel system and evaporative emissions system without increasing undesired exhaust emissions, and wherein, upon sealing the fuel system and evaporative emissions control system, pressure bleed-up may be monitored to determine the presence or absence of undesired evaporative emissions, without complications due to fuel vaporization effects.

The systems described herein and with reference to FIG. 1 and FIG. 2, along with the methods described herein and with reference to FIGS. 3-4, may enable one or more systems and one or more methods. In one example, a method comprises during a first operating mode, routing fuel vapors from a fuel tank through a first vapor storage device into an intake manifold of an internal combustion engine; and during a second operating mode, routing fuel vapors from the fuel tank through a second vapor storage device but not through the first vapor storage device. In a first example of the method, the method further comprises shutting off a valve positioned between the first vapor storage device and the second vapor storage device during the second operating mode. A second example of the method optionally includes the first example and further comprises venting the second vapor storage device to atmosphere during the second operating mode. A third example of the method optionally includes any one or more or each of the first and second examples and further includes wherein the second storage device is not vented to atmosphere during first operating mode. A fourth example of the method optionally includes any one or more or each of the first through third examples and further includes wherein fuel vapors from the fuel tank and not from the second vapor canister are routed through the first vapor storage device into the intake manifold during the first operating mode. A fifth example of the method optionally includes any one or more or each of the first through fourth examples and further includes wherein the first operating mode includes operation under predetermined temperature conditions. A sixth example of the method optionally includes any one or more or each of the first through fifth examples and further includes wherein the temperature conditions comprise one or more of the following: engine coolant temperature below a predetermined temperature; or, ambient temperature below a preset temperature for a predetermined time.

Another example of a method comprises during vapor purging conditions, purging fuel vapors from a fuel tank through a first vapor storage device into an intake manifold of an internal combustion engine, venting a second vapor storage device to atmosphere and purging fuel vapors from the second vapor storage device through the first storage device into the intake manifold; in response to turning off the engine, venting the second storage device to atmosphere and routing fuel vapors from the fuel tank through the second vapor storage device but not through the first vapor storage device; and during a cold start of the engine, sealing the second storage device from atmosphere and routing fuel vapors from the fuel tank through the first storage device into the intake manifold of the engine. In a first example of the method, the method further includes wherein the vapor purging conditions comprise a catalyst coupled to an exhaust of the engine being at a temperature sufficient for catalytic oxidation of hydrocarbons in the exhaust. A second example of the method optionally includes the first example and further includes wherein the engine cold start comprises a start of the engine in which the catalyst has not reached a sufficient temperature to oxidize the hydrocarbons in the exhaust. A third example of the method optionally includes any one or more or each of the first and second examples and further includes wherein the routing of fuel vapors from the fuel tank through the first storage device into the intake manifold of the engine continues until a negative pressure in the fuel tank reaches a preset negative pressure. A fourth example of the method optionally includes any one or more or each of the first through third examples and further comprises decoupling the intake manifold from the fuel tank when the fuel tank reaches the preset negative pressure but continuing to seal the fuel tank and second storage device from atmosphere. A fifth example of the method optionally includes any one or more or each of the first through fourth examples and further comprises indicating undesired emissions from the fuel tank or second storage device if the fuel tank pressure exceeds a threshold pressure during a predetermined time after decoupling the intake manifold from the fuel tank. A sixth example of the method optionally includes any one or more or each of the first through fifth examples and further comprises discontinuing the purging when fuel vapors in the fuel tank, and stored fuel vapors in the first vapor storage device and the second storage device, fall below a predetermined level or are substantially absent.

An example of a system comprises an internal combustion engine having an intake manifold and an exhaust manifold, the engine driving a vehicle; a catalytic converter coupled to the exhaust manifold; a fuel tank having a fuel vapor outlet which is connected in series to a one-way check valve which is connected in series with a fuel vapor storage buffer which in turn is connected in series to a purge valve that is connected to the intake manifold; a fuel vapor storage canister having a load input connected to the fuel tank and a purge outlet connected to the one-way check valve, and a vent valve coupled to atmosphere; and a controller, storing instructions in non-transitory memory, that when executed, cause the controller to: during engine purge conditions, open the purge control valve and the canister vent valve; and during evaporative emission testing conditions, in which the catalytic converter is at a temperature below that needed for catalytic activity, start the engine, seal the vent valve, and open the purge valve until a predetermined negative pressure is reached in the fuel tank; and after the predetermined negative pressure is reached, close the purge valve and indicate undesired evaporative emissions are present if the fuel tank pressure exceeds a threshold pressure within a predetermined time after closing the purge valve. In a first example, the system further comprises one or more temperature sensor(s), positioned within either or both of the fuel vapor storage buffer and/or the fuel vapor canister. A second example of the system optionally includes the first example and further comprises a gas cap coupled to the fuel tank. A third example of the system optionally includes any one or more or each of the first and second examples and further includes wherein the controller, during refilling of the fuel tank through the gas cap, cause the closing of the purge valve and opening of the vent valve so that fuel vapors from the fuel tank are routed through the fuel vapor storage canister for adsorption therein. A fourth example of the system optionally includes any one or more or each of the first through third examples and further includes wherein the controller causes the discontinuing of purging when fuel vapors in the fuel tank, and stored fuel vapors in the fuel vapor storage buffer and the fuel vapor storage canister, fall below a predetermined level or are substantially absent. A fifth example of the system optionally includes any one or more or each of the first through fourth examples and further comprises an exhaust gas oxygen sensor positioned in the engine exhaust and the controller further comprises the learning of concentration of fuel vapors purged into the intake manifold in response to an output from the exhaust gas oxygen sensor.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system comprising:

an internal combustion engine having an intake manifold and an exhaust manifold, the internal combustion engine driving a vehicle;

a catalytic converter coupled to the exhaust manifold;

a fuel tank having a fuel vapor outlet which is connected in series to a one-way check valve which is connected in series with a fuel vapor storage buffer which in turn is connected in series to a purge valve that is connected to the intake manifold;

a fuel vapor storage canister having a load input connected to the fuel tank and a purge outlet connected to the one-way check valve, and a vent valve coupled to atmosphere; and a controller, storing instructions in a non-transitory memory that, when executed, cause the controller to: during internal combustion engine purge conditions, open the purge valve and the vent valve; and, during evaporative emission testing conditions, in which the catalytic converter is at a temperature below that needed for catalytic activity, start the internal combustion engine, seal the vent valve, and open the purge valve until a predetermined negative pressure is reached in the fuel tank; and, after the predetermined negative pressure is reached, close the purge valve and indicate undesired evaporative emissions are present if a fuel tank pressure exceeds a threshold pressure within a predetermined time after closing the purge valve.

2. The system of claim 1, further comprising one or more temperature sensor(s), positioned within the fuel vapor storage buffer and/or the fuel vapor storage canister.

3. The system of claim 1, further comprising a gas cap coupled to the fuel tank.

4. The system of claim 3, wherein the controller, during refilling of the fuel tank, causes a closing of the purge valve and opening of the vent valve so that fuel vapors from the fuel tank are routed through the fuel vapor storage canister for adsorption therein.

5. The system of claim 1, wherein the controller causes the discontinuing of purging when fuel vapors in the fuel tank, and stored fuel vapors in the fuel vapor storage buffer and the fuel vapor storage canister, fall below a predetermined level or are substantially absent.

6. The system of claim 5, further comprising an exhaust gas oxygen sensor positioned in an engine exhaust passage and the controller further causes a learning of a concentration of fuel vapors purged into the intake manifold in response to an output from the exhaust gas oxygen sensor.

* * * * *